US006236368B1

(12) United States Patent
Johson

(10) Patent No.: US 6,236,368 B1
(45) Date of Patent: May 22, 2001

(54) LOOP ANTENNA ASSEMBLY FOR TELECOMMUNICATION DEVICES

(75) Inventor: Greg Johson, Aptos, CA (US)

(73) Assignee: RangeStar International Corporation, Aptos, CA (US)

( * ) Notice: Subject to any disclaimer, the term of this patent is extended or adjusted under 35 U.S.C. 154(b) by 0 days.

(21) Appl. No.: 09/296,231

(22) Filed: Apr. 22, 1999

Related U.S. Application Data

(63) Continuation of application No. PCT/US98/18800, filed on Sep. 10, 1998.
(60) Provisional application No. 60/058,478, filed on Sep. 10, 1997.

(51) Int. Cl.[7] ..... H01Q 1/24
(52) U.S. Cl. ..... 343/702; 343/741; 343/700 MS
(58) Field of Search ..... 343/702, 866, 343/741, 700 MS, 855

(56) References Cited

U.S. PATENT DOCUMENTS

| | | | | |
|---|---|---|---|---|
| 3,696,431 | | 10/1972 | Holland | 343/713 |
| 4,184,164 | | 1/1980 | Rod | 343/744 |
| 4,804,965 | | 2/1989 | Roederer | 343/700 |
| 4,847,626 | * | 7/1989 | Kahler et al. | 343/700 MS |
| 4,924,237 | | 5/1990 | Honda et al. | 343/702 |
| 4,983,985 | | 1/1991 | Beatty | 343/741 |
| 5,198,826 | | 3/1993 | Ito | 343/726 |
| 5,371,507 | | 12/1994 | Kuroda et al. | 343/700 |
| 5,539,414 | | 7/1996 | Keen | 343/700 |
| 5,541,610 | | 7/1996 | Imanishi et al. | 343/702 |
| 5,557,293 | * | 9/1996 | McCoy et al. | 343/867 |
| 5,583,523 | * | 12/1996 | Wallace, Jr. | 343/741 |
| 5,710,987 | | 1/1998 | Paulick | 455/90 |
| 5,714,961 | | 2/1998 | Kot et al. | 343/769 |
| 5,767,809 | * | 6/1998 | Chuang et al. | 343/700 MS |
| 5,826,178 | | 10/1998 | Owen | 455/193.1 |
| 5,926,139 | * | 7/1999 | Korisch | 343/702 |
| 5,929,825 | | 7/1999 | Niu et al. | 343/895 |
| 5,945,959 | * | 8/1999 | Tanidkoro et al. | 343/728 |
| 6,016,128 | * | 1/2000 | Imamura et al. | 343/741 |

FOREIGN PATENT DOCUMENTS 5-211407 * 8/1993 (JP) .

* cited by examiner

*Primary Examiner*—Hoanganh Le
*Assistant Examiner*—Ephrem Alemu
(74) *Attorney, Agent, or Firm*—Larkin, Hoffman, Daly & Lindgren, Ltd.; John F. Klos, Esq.

(57) ABSTRACT

A loop directive antenna having improved front-to-back ratio and gain for given input power levels assembly for a hand-held radio frequency transceiver, such as a cellular telephone or PCS device operating in the 800–900 or 1850–1990 MHz. frequency ranges, respectively, is provided by the present invention. The loop directive antenna assembly consists of a main loop antenna conductor disposed upon a dielectric element. The main loop antenna conductor and dielectric element are maintained a predetermined distance away from a ground plane, which may be the circuit board or other conductive element. The main loop antenna conductor may include a variety of feedpoint orientations to provide alternative polarizations of the transmitted signal. The ground plane may be a portion of the printed circuit board of the device, a conductive part of the device housing, the battery pack of the device, or a separate conductive panel.

26 Claims, 7 Drawing Sheets

LOOP ANTENNA ASSEMBLY FOR TELECOMMUNICATION DEVICES

CROSS REFERENCE TO RELATED APPLICATIONS

This application claims the benefit of priority pursuant to 35 U.S.C §119(e)(1) from the provisional patent application filed pursuant to 35 USC §111(b): as Ser. No. 60/058,478 on Sep. 10, 1997.

This application is a continuation of PCT Ser. No. PCT/US98/18800, filed Sep. 10, 1998.

BACKGROUND OF THE INVENTION

The present invention relates generally to an antenna assembly, and more particularly to a loop antenna assembly for a hand-held radio frequency transceiver, such as a cellular telephone or PCS device operating in the 800–900 or 1850–1990 MHz. frequency ranges, respectively.

DESCRIPTION OF THE PRIOR ART

There has been a recognized need for a compact antenna assembly for a hand-held radio frequency transceiver which offers increased performance in gain and front-to-back ratio at given input power levels. It is recognized that prior art monopole antennae, while providing good radiation characteristics and desirable drive point impedance, may be more subject to damage than a compact antenna protected within the interior of the transceiver housing.

Performance limitations of many other prior antennas for radio frequency transceivers have included limited signal range, limited directionality, significant radio frequency radiation output to the user, and significant multipath interference.

SUMMARY OF THE INVENTION

A compact loop directive antenna having improved front-to-back ratio and gain for given input power levels is provided by the present invention. Such a compact antenna would replace the popular monopole or whip-style antennas in current use and may be installed within the interior of the transceiver. The loop antenna assembly consists of a main loop antenna conductor disposed upon a dielectric substrate element. The main loop antenna conductor and dielectric element are maintained a predetermined distance away from a ground plane, which may be defined by a portion of the circuit board or other conductive member of the transceiver. The main loop antenna conductor can be formed as either a closed loop or open loop and may include a variety of feedpoint orientations to provide alternative polarizations of the transmitted signal. The ground plane may be defined by a portion of the printed circuit board of the device, a conductive part of the device housing, the battery pack of the device, or a separate conductive panel. Several purposes and objects of the disclosed apparatusses are described herein. One object of the present disclosure is to provide a compact antenna assembly with improved directionality and gain at given input power levels Additional improvements and benefits of the antenna assembly of the present invention include: increased signal strength resulting in extended signal range and fewer dropped calls for a given power consumption rate; an increased battery life for a given output signal level; reduced radio frequency radiation incident to the user's body; a reduction in the physical size of a directional antenna for use on a wireless device; and, protection of the antenna structure from external damage.

Accordingly, it is a primary object of the present invention to provide an improved compact antenna assembly for communication devices with improved directionality, broadband input impedance, increased signal strength, and increased battery life.

Other benefits include a reduction in multipath interference and increased front-to-back ratio.

A DETAILED DESCRIPTION OF THE PREFERRED EMBODIMENTS

Figure 1:
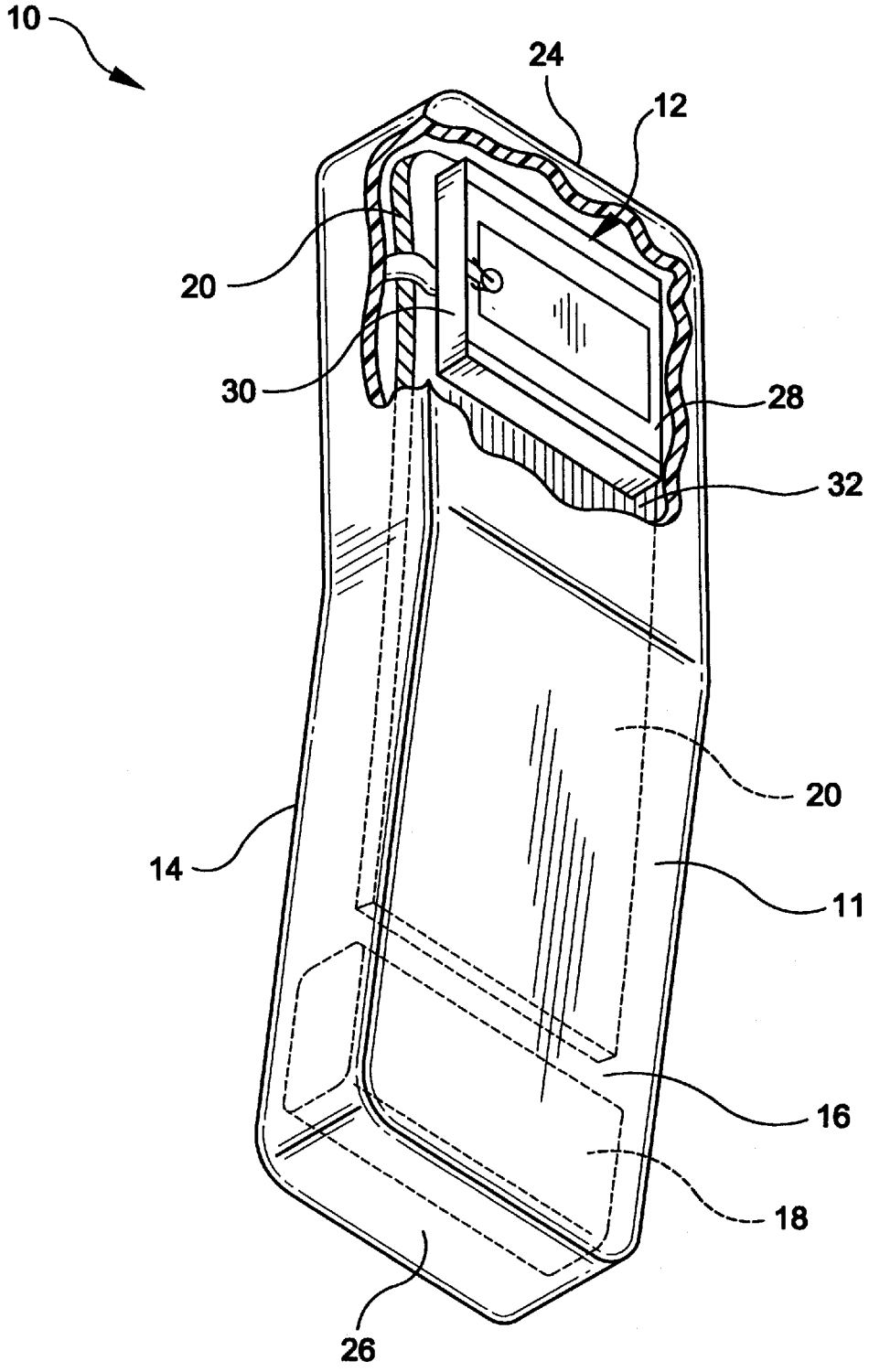
FIG. 1 is a perspective view of a communication device incorporating an antenna assembly according to the present invention.

FIG. 1 illustrates a perspective view of a hand-held cellular telephone handset 10 and antenna assembly 12. Telephone handset 10 includes a front side 14 having speaker and microphone (not shown) and a rear side 16. Handset 10 is electrically powered by a battery or battery pack 18. Handset 10 includes one or more printed circuit boards 20 used to receive components and route signals between the multiple electronic components. Printed circuit board 20 in this embodiment also establishes a ground plane 32 for the antenna assembly 12. Alternative ground planes 32 may also be incorporated into the antenna assembly 12 as described hereinafter.

Antenna assembly 12 is revealed in FIG. 1 through a partial break-away of the handset 10 housing 11. The housing 11 may be made of an electrically nonconductive material. Antenna assembly 12 is positioned nearer to the top 24 than the bottom 26 of the handset 10 so that a user's hand will normally be away from the antenna assembly 12. Immunity to hand induced radiation losses is desirably improved by this placement of the antenna assembly 12 upon the handset 10.

Figure 2:
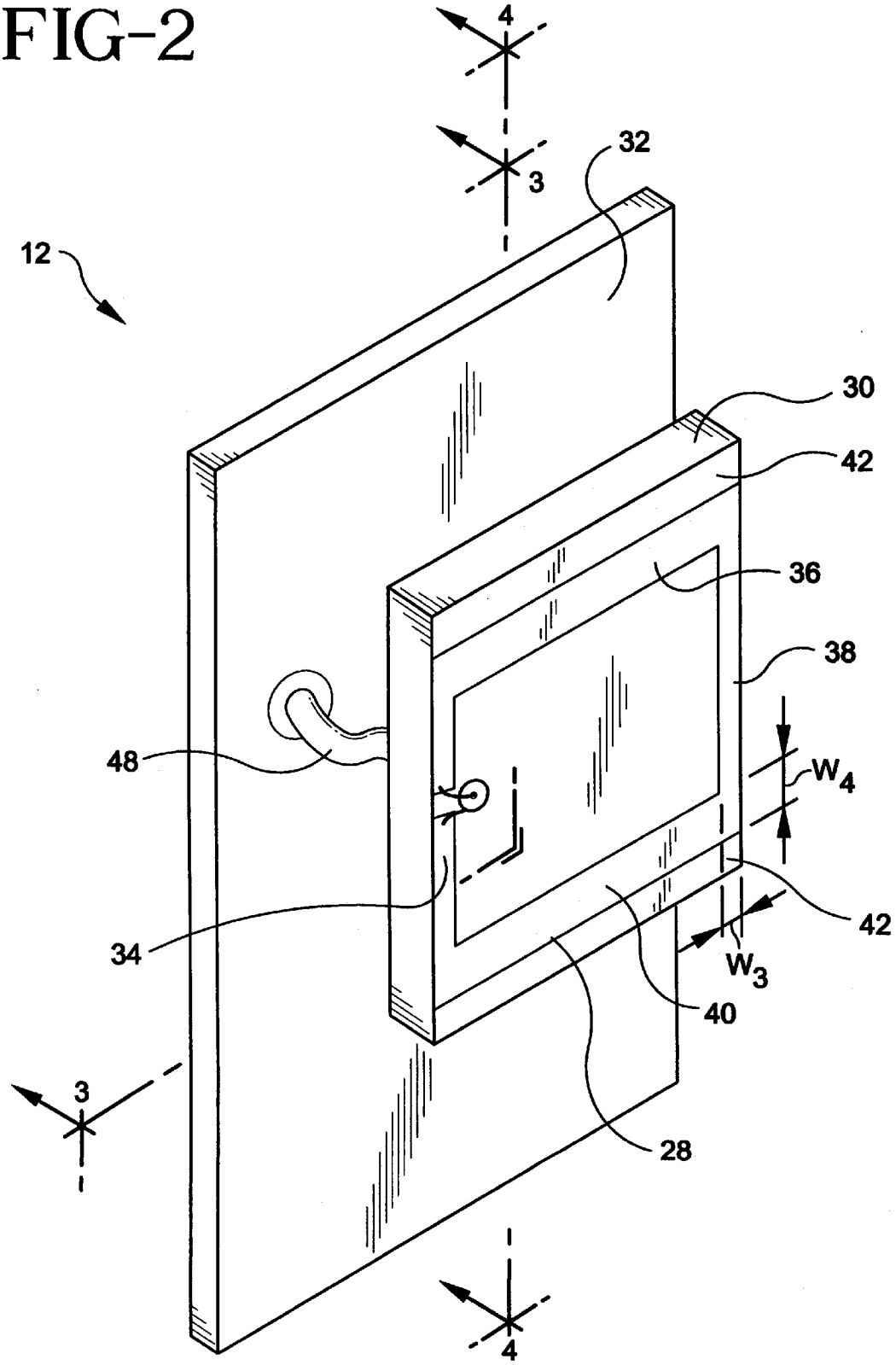
FIG. 2 is a detailed perspective view of the antenna assembly of FIG. 1.

FIG. 2 illustrates the antenna assembly 12 in perspective view. Antenna assembly 12 generally includes a loop conductor element 28, a dielectric substrate 30, and a ground plane 32. Loop conductor element 28 is generally square in shape; i.e., all four sides 34, 36, 38, 40 are of equal length. Top and bottom (horizontal) sides 36, 40 of loop conductor element 28 extend laterally across the dielectric substrate 30 to its periphery. The right and left sides 34, 38 (vertical) of the loop conductor element 28 are shorter than the dielectric side length, and thus portions 42 of the dielectric substrate 30 extend beyond the loop conductor element 28 generally adjacent the horizontal sides 36, 40. The circumference of the loop conductor element 28 is approximately one wavelength (1λ) of a frequency selected within the operating range of the handset 10.

Referring still to FIG. 2, the widths of the horizontal portions 36, 40 ($w_4$), and vertical portions 34, 38 ($w_3$) of the loop conductor 28 are approximately 0.12 and 0.06 inch, respectively, with a thickness, $h_1$, of approximately 0.005 inch for the 1850–1990 MHz. frequency range. The ratio between the top and bottom portion width, $w_4$, and the side portion width, $w_3$, is approximately 2:1. These dimensions, except $h_1$ (thickness), would approximately double for operation in the 800–900 MHz. frequency range.

Figure 3:
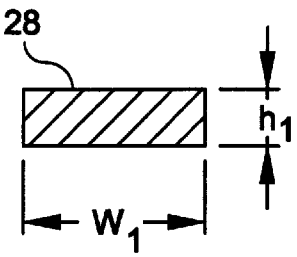
FIG. 3 is an elevational view of portion of the antenna assembly of FIG. 2, taken along lines 3—3.

Illustrated in FIG. 3 is a cross-sectional view of the loop conductor element 28. The height dimension, $h_1$, of the loop conductor element 28 is approximately 0.005 inch. The width, $w_1$, of the loop conductor element 28 may range from 0.125 to 0.05 inch. Preferably for a width of 0.125 inch, the height should range between 0.001 to 0.020 inch. Preferably for a width of 0.05 inch, the height should range between 0.0005 and 0.032 inch.

Loop conductor 28 is illustrated herein as square-shaped when viewed from above, though alternative configurations such as circular, rectangular, or triangular shapes may also be practicable. Loop conductor 28 is formed by selectively etching away a conductive layer deposited upon a surface of the dielectric substrate 30. Alternatively, loop conductor 28 may be applied with known circuit printing techniques or may be a conductive wire affixed to the substrate 30 surface.

Still referring to FIG. 2, the dielectric substrate 30 is a layer of dielectric material selected to have a dielectric constant between 1 and 10. A further preferred range of the dielectric constant is approximately between 9 and 10. Dielectric substrate 30 is illustrated in the drawings as rectangular in form, though alternatively, substrate 30 may assume other shapes and configurations, i.e. circular, etc. Dielectric substrate 30 is substantially planar in configuration, and may be curved as in FIG. 10 or otherwise conformed to the internal shape of a portion of the handset. Dielectric substrate 30 thickness may range from approximately 0.03 to 0.5 inch. Dielectric substrate 30 has a thickness of 0.25 (¼) inch with a dielectric constant of 9.2 for the 1850–1990 MHz. frequency operating range.

Figure 4:
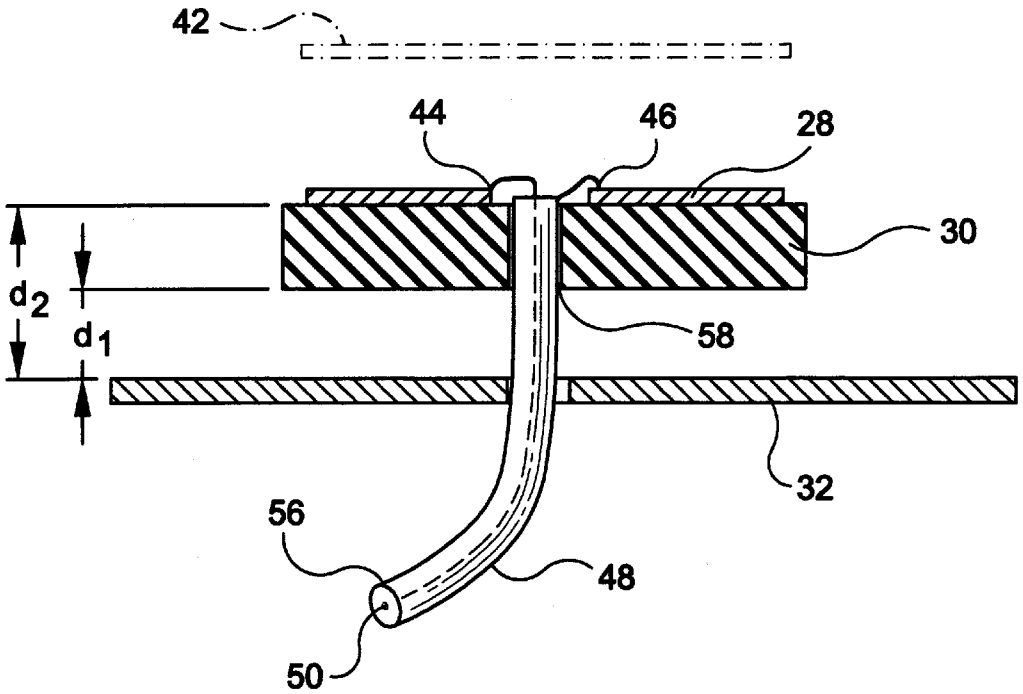
FIG. 4 is an elevational view of the antenna assembly of FIG. 2, taken along lines 4—4.

Referring to FIG. 4, a distance, $d_2$, between the loop conductor element 28 and the ground plane 32 is within the range of approximately 0.05 and 0.30 times a desired wavelength (0.05λ–0.30λ). Dielectric substrate 30 and loop conductor element 28 are maintained a distance, $d_1$, away from the ground plane 32 by a support structure (not shown). For operation of the antenna assembly 12 at the 1850–1990 MHz. frequency range, the distance, $d_1$, is approximately 0.3–1.5 inches. Support structure may include a foam support between the dielectric substrate 30 and the ground plane 32.

Ground plane 32 of the antenna assembly is illustrated as a portion of the printed circuit board 20 of the handset 10. Alternatively, the ground plane 32 may be a conductive portion of the handset housing, the battery pack 18 or portion thereof, or even a separate conductive panel (not shown).

Referring again to FIG. 4, a parasitic element 42 in the form of conductive loop or linear dipole may be utilized to increase the antenna assembly 12 gain. Parasitic element 42 may be positioned away from the loop conductor element 28 a distance of approximately 0.05λ to 0.25λ. The loop parasitic element 42 is substantially parallely aligned with the loop conductor element 28 and the dielectric substrate 30. The linear dipole parasitic element 42 is also substantially parallel with vertical sides 34, 38 of loop conductor element 28.

Still referring to FIG. 4, the feed point connections 44, 46 of the antenna assembly 12 to the transmitter electronics are illustrated. A coax feedline 48 having a nominal 50 ohm impedance is utilized. Center conductor 50 of coax line 48 is electrically connected at an end 44 of loop conductor element 28, while shield element 56 is electrically connected at the other end 46 of the loop conductor element 28. Coax line 48 passes through an aperture 58 in the dielectric substrate 30 to provide relatively short leads between the coax 48 and the feed point connections 44, 46. The aperture 58 is generally defined in the area between the opposed ends 44, 46 of the loop conductor 28.

Figure 5:
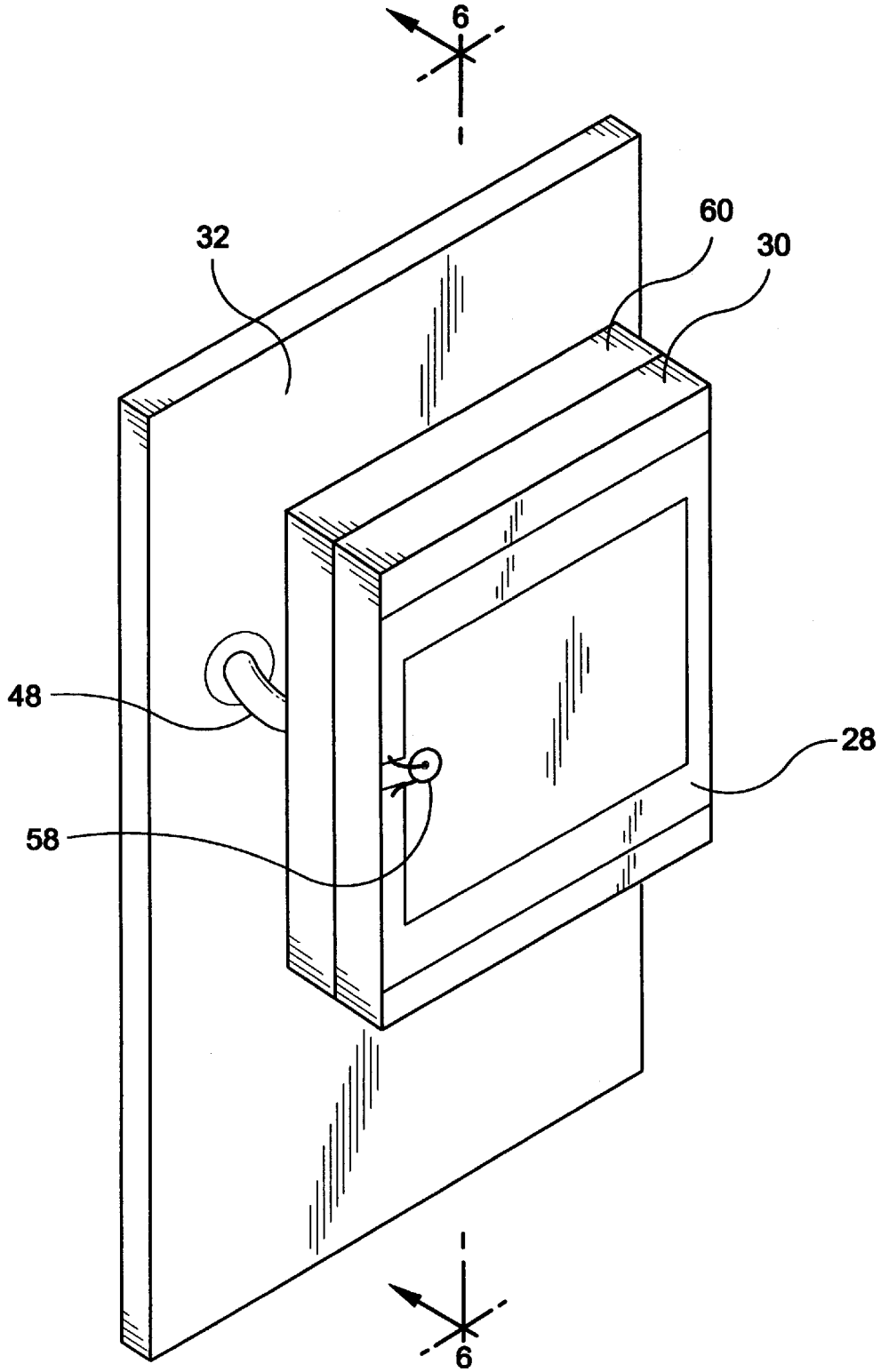
FIG. 5 is a perspective view of a second embodiment of the antenna assembly according to the present invention.
Figure 6:
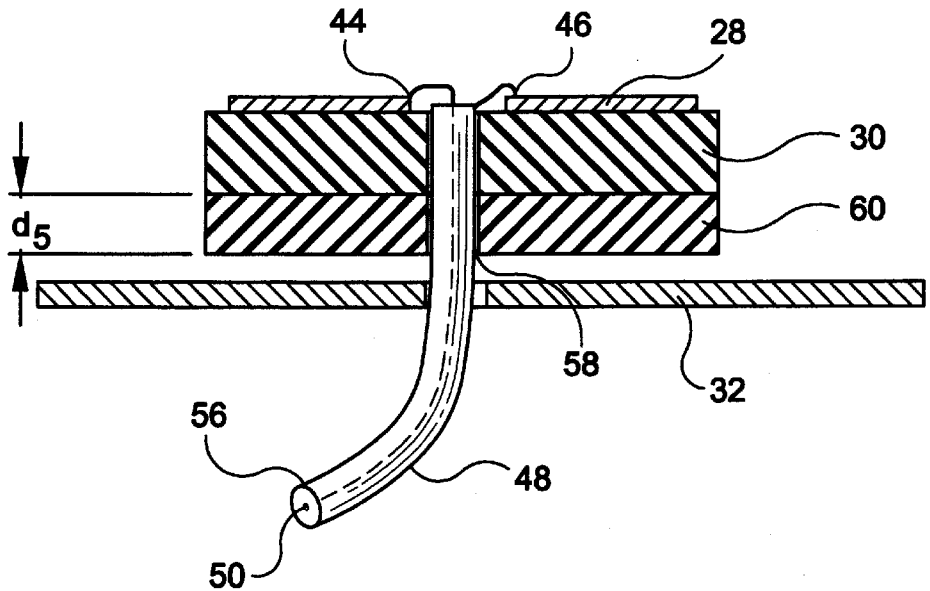
FIG. 6 is an elevational view of the antenna assembly of FIG. 5, taken along lines 6—6.

FIGS. 5 and 6 illustrate a second embodiment of the present invention. These figures illustrate an antenna assembly 12 similar to that of FIG. 2, except for the addition of another dielectric substrate layer 60 disposed between the ground plane member 32 and the first dielectric substrate layer 30. The second dielectric substrate 60 is selected with a dielectric constant between 1 and 40 and has a thickness of up to 0.5 inch.

Figure 7:
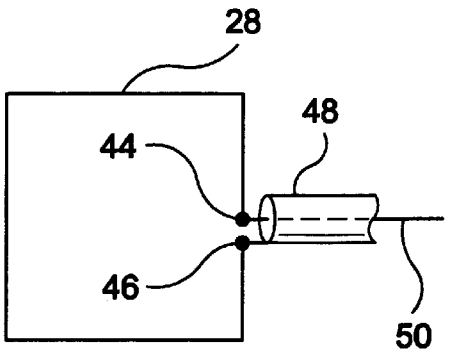
FIG. 7 is a diagrammatic view of an antenna assembly according to the present invention, having a first feedpoint orientation.
Figure 9:
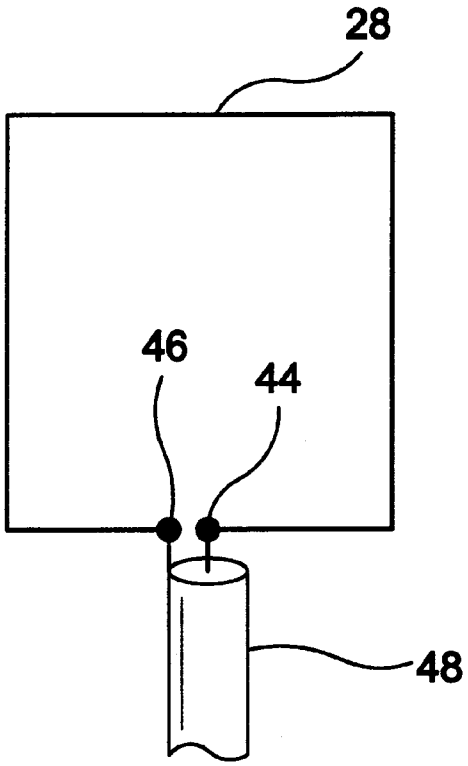
FIG. 9 is a diagrammatic view of an antenna assembly according to the present invention, having a third feedpoint orientation.
Figure 8:
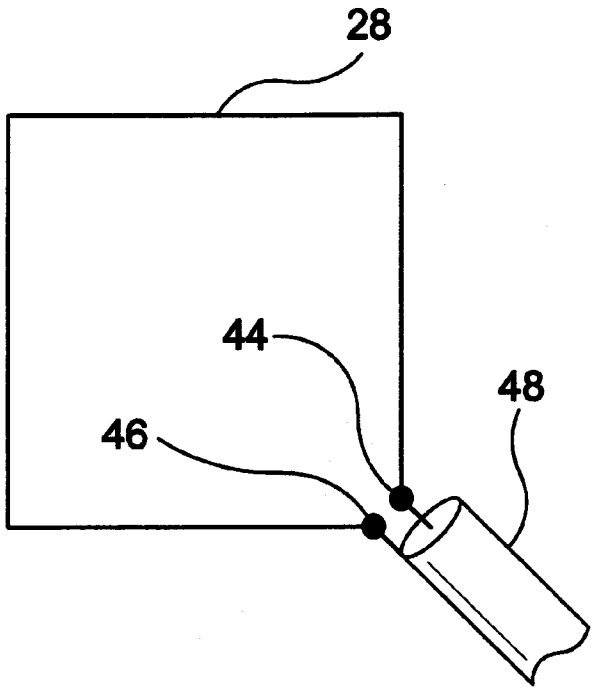
FIG. 8 is a diagrammatic view of an antenna assembly according to the present invention, having a second feedpoint orientation.
Figure 10:
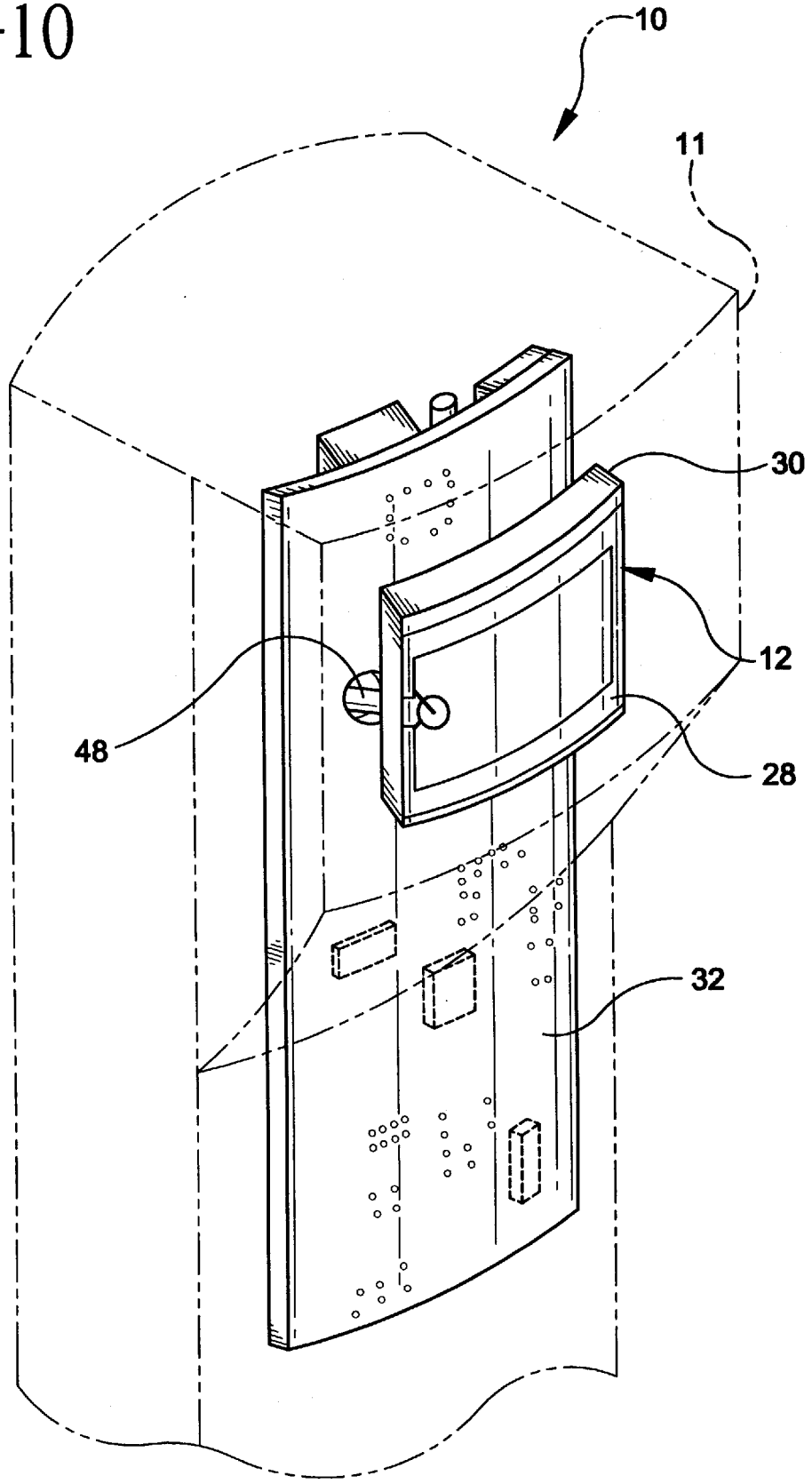
FIG. 10 is a perspective view of a third embodiment of the antenna assembly according to the present invention.

With reference to FIGS. 7, 8 and 9, various feed point orientations may be utilized in the antenna assembly 12. FIG. 7 depicts a feed point connection which results in vertical polarization of the transmitted radio signal. FIG. 8 depicts a feed point connection which results in a slant-linear polarization. FIG. 9 depicts a feed point connection which results in horizontal polarization of the transmitted radio signal FIG. 10 illustrates another embodiment of the present invention. Unlike the planar nature of the first and second embodiments, this embodiment illustrates a curved or conformal antenna assembly. Dielectric substrate 30 and loop conductor element 28 have a generally concave cross section and are related in shape to an interior surface of the housing 11 of the communication device 10. As the dielectric substrate 30 and loop conductor element 28 are conformed to an internal surface of the handset 10, packaging requirements may be minimized.

The above described embodiments of the invention are merely descriptive of its principles and are not to be considered limiting. Further modifications of the invention herein disclosed will occur to those skilled in the respective arts and all such modifications are deemed to be within the scope of the invention as defined by the following claims. Such modifications may include, but are not limited to, alternations of the loop configuration, selection of materials, and additions of elements.

I claim:

1. An antenna assembly for a hand-held radio frequency transceiver having a signal conductor and a ground conductor, said antenna assembly comprising:

a conductive ground plane element;

a dielectric substrate element having a first surface, said first surface maintained a predetermined distance away from the conductive ground plane element; and a loop element disposed upon the first surface of the dielectric substrate element, said loop element having first and second ends disposed generally opposite each other, the signal conductor of the transceiver being coupled proximate said first end, and the ground conductor being coupled proximate said second end, said loop element having a plurality of side elements each having an associated width presented on the dielectric substrate, and wherein the widths of at least a pair of said plurality of side elements are substantially different.

2. The antenna assembly according to claim 1 wherein at least a portion of the ground plane element is defined by either a printed circuit board or a battery pack or a conductive panel of the transceiver.

3. The antenna assembly according to claim 1 wherein the dielectric substrate element has a dielectric constant of between 1 and 10.

4. The antenna assembly according to claim 3 wherein the dielectric substrate element has a dielectric constant between approximately 9 and 10.

5. The antenna assembly according to claim 1 wherein the loop element is generally square in shape having a top side, a bottom side, a right side, and a left side, and said top side and said bottom side having equal widths, and said right side and said left side having equal widths.

6. The antenna assembly according to claim 5 wherein the top side width and right side width are related by a ratio of approximately 2:1.

7. The antenna assembly according to claim 1 wherein the loop element has a length of approximately one wavelength of a frequency selected within an operating range of frequencies of the transceiver.

8. The antenna assembly according to claim 1 wherein the dielectric substrate element is substantially planar in form.

9. The antenna assembly according to claim 1 wherein the antenna assembly is disposed near a top portion of the transceiver during use.

10. The antenna assembly according to claim 1 wherein the predetermined distance of the first surface of the dielectric substrate element to the ground plane element is approximately between 0.05 to 0.30 times a wavelength of a frequency selected within an operating range of frequencies of the transceiver.

11. The antenna assembly according to claim 1 wherein the dielectric substrate element is disposed upon at least a portion of the conductive ground plane element.

12. A portable radio frequency communication device comprising:

an electrical apparatus having a signal conductor and an associated ground conductor and a ground plane element;

a loop element having generally opposite ends disposed relative to the ground plane element, said loop element being electrically coupled at one end to the signal conductor and at the other end to the ground conductor, said loop element having a plurality of side elements, each of said side elements having an associated width, and at least a pair of said plurality of side elements having different widths; and a dielectric substrate element disposed between the loop element and at least a portion of the ground plane element.

13. The portable radio frequency communication device according to claim 12 wherein the loop element is disposed upon the dielectric substrate element.

14. The portable radio frequency communication device according to claim 12 wherein the dielectric substrate element is substantially planar in form.

15. The portable radio frequency communication device according to claim 12 further comprising:

a parasitic element disposed away from the active loop conductor element and operatively coupled to the loop element.

16. A radio frequency communication device, said communication device comprising:

a printed circuit board having a radio frequency circuit having a signal conductor and an associated ground conductor and a ground plane;

a loop radiating element having a first end and a second end, said loop radiating element being operatively coupled to the signal conductor proximate the first end and to the ground conductor proximate the second end, said loop radiating element having a length between the first end and the second end, said radiating loop element having a plurality of side elements each having an associated width, and wherein the widths of at least a pair of said plurality of side elements are different; and a dielectric substrate element disposed between the loop radiating element and at least a portion of the ground plane.

17. The communication device according to claim 16 wherein the loop radiating element is disposed upon the dielectric substrate element.

18. The communication device according to claim 16 wherein the dielectric substrate element is substantially planar in form.

19. The communication device according to claim 16 wherein the dielectric substrate element has a dielectric constant of between 9 and 10.

20. The radio frequency communication device according to claim 16 further comprising:

a parasitic element disposed away from the loop radiating element and being operatively coupled to the conductive loop radiating element.

21. A transceiver comprising:

a radio frequency circuit;

a coax feedline having a first and second end and a predetermined diameter, each end having an associated first and second conductor, said fist and second conductor of the first end being operatively coupled to the radio frequency circuit;

a conductive ground plane circuit;

a dielectric substrate element having a first surface, said first surface maintained a predetermined distance away from the conductive ground plane element, said dielectric substrate having an aperture sized in relation to the predetermined diameter to pass both the first and second conductors of the second end of the coax feedline; and a loop element disposed upon the first surface of the dielectric substrate element, said loop element having opposed first and second ends and an area intermediate said first and second ends, said intermediate area containing the aperture of the dielectric substrate, said first and second ends of the loop being respectively coupled to the first and second conductors associated with the second end of the coax feedline, said loop element having a plurality of side elements each having an associated width presented on the dielectric substrate, and wherein the widths of at least a pair of said plurality of side elements are different.

22. The antenna assembly according to claim 21 wherein the loop element includes a plurality of side elements, and at least a pair of said plurality of side elements having different widths.

23. The antenna assembly according to claim 21 wherein the ground plane element is defined at least in part by the radio frequency circuit.

24. A conformal antenna assembly for a radio frequency communication device providing a signal conductor and an associated ground conductor and having a housing, said housing having a formed surface, said conformal antenna assembly comprising:

a ground plane element;

a dielectric substrate element having a conformed surface disposed between the ground plane element and the formed surface of the housing and being related to the formed surface of the housing, and a loop radiating element disposed upon the conformed surface of the dielectric substrate element, said loop radiating element defining a pair of ends and being coupled proximate one end to the signal conductor, and being coupled proximate the other end to the ground conductor, said loop radiating element having a plurality of side elements each having an associated width presented on the dielectric substrate, and wherein the widths of at least a pair of said plurality of side elements a different.

25. The conformal antenna assembly of claim 24 wherein the formed surface of the communication device and the conformed surface of the dielectric substrate element are both approximately cylindrical in profile.

26. The conformal antenna assembly of claim 24 wherein the ground plane element is defined at least in part by a printed circuit board or a battery pack or a conductive panel of the communication device.

* * * * *

UNITED STATES PATENT AND TRADEMARK OFFICE

CERTIFICATE OF CORRECTION

PATENT NO. : 6,236,368 B1
DATED : May 22, 2001
INVENTOR(S) : Greg Johnson

It is certified that error appears in the above-identified patent and that said Letters Patent is hereby corrected as shown below:

Title page,
Item [75], the inventor's name should be changed from "Greg Johson" to -- Greg Johnson --.

Signed and Sealed this

Eleventh Day of June, 2002

*Attest:*

*Attesting Officer*

JAMES E. ROGAN
*Director of the United States Patent and Trademark Office*